US006128367A

United States Patent [19]

Foerst et al.

[11] Patent Number: 6,128,367

[45] **Date of Patent: *Oct. 3, 2000**

[54] X-RAY TUBE

[75] Inventors: Bernhard Foerst, Ebermannstadt; Marion Meusel; Roland Schmidt, both of Erlangen, all of Germany

[73] Assignee: Siemens Aktiengesellschaft, Munich, Germany

[ * ] Notice: This patent is subject to a terminal disclaimer.

[21] Appl. No.: 09/120,287

[22] Filed: Jul. 22, 1998

[30] Foreign Application Priority Data

Jul. 24, 1997 [DE] Germany ..... 197 31 988

[51] Int. Cl.[7] ..... H01J 35/30

[52] U.S. Cl. ..... 378/137; 378/138; 378/121; 378/145

[58] Field of Search ..... 378/137, 138, 378/121, 143, 144, 145

[56] References Cited

U.S. PATENT DOCUMENTS

| | | | |
|---|---|---|---|
| 4,554,610 | 11/1985 | Metz et al. | 361/144 |
| 5,313,510 | 5/1994 | Ebersberger et al. | 378/12 |
| 5,812,632 | 9/1998 | Schardt et al. | 378/137 |
| 5,822,395 | 10/1998 | Schardt et al. | 378/137 |
| 5,833,936 | 3/1999 | Hell et al. | 378/125 |
| 5,898,755 | 4/1999 | Meusel et al. | 378/137 |
| 5,909,479 | 6/1999 | Rother | 378/121 |
| 6,055,294 | 4/2000 | Foerst et al. | 378/138 |

FOREIGN PATENT DOCUMENTS

| | | |
|---|---|---|
| 0 460 421 | 12/1991 | European Pat. Off. . |
| 41 25 926 | 8/1992 | Germany . |

OTHER PUBLICATIONS

"Elektronenstrahl–Technologie," Schiller et al. (1977), pp. 89–95.

*Primary Examiner*—David P. Porta
*Assistant Examiner*—Allan C. Ho
*Attorney, Agent, or Firm*—Hill & Simpson

[57] ABSTRACT

An x-ray tube has a cathode and an anode which are arranged in a vacuum housing, with an electromagnet for deflecting the electron beam traveling from the cathode to the anode. This electromagnet is formed by a C-shaped yoke with two legs that are connected to each other by a base section surrounded by a winding. Respective pole shoes with opposing pole faces are disposed at the ends of the legs. The electron beam passes between the two pole shoes as it propagates from the cathode to the anode. Each pole face has a width which does not exceed the width of its pole shoe.

9 Claims, 2 Drawing Sheets

X-RAY TUBE

BACKGROUND OF THE INVENTION

1. Field of the Invention

The present invention relates to an x-ray tube of the type having a cathode and an anode which are arranged in a vacuum housing arrangement for magnetic deflection of the electron beam.

2. Description of the Prior Art

The possibility of deflecting the electron beam and thus the focal spot is particularly significant in connection with computed tomography, since by the known measure of displacing the focal spot between two end positions, an improvement of the image quality can be achieved therein by a multiplication of the data which are made available for the calculation of the image of a body slice.

German OS 41 25 926 and European Application 0 460 421 A1 disclose x-ray tubes of the above type. To avoid distortion of the focus geometry caused by the deflection of the electron beam, such distortions affecting the imaging quality, the magnetic field generated in the vicinity of the electron beam in the plane proceeding at a right angle to the propagation path of the electron beam must not have any notable gradients.

The x-ray tube taught by European Application 0 460 421 A1, in which the arrangement for deflecting the electron beam is formed by a deflection unit surrounding the shaft-shaped housing part, is not able to fulfil this requirement. Rather, the deflection unit effects not only a deflection, but also a defocusing of the electron beam. As a result of this effect of the deflection unit, the focal spot emerging at the point of impact of the electron beam on the incidence surface of the anode experiences not only a displacement on this anode surface, but also an undesirable change in size and/or shape.

In the x-ray tube described in German OS 41 25 926 the arrangement for deflecting the electron beam is formed by an air coil arranged outside the vacuum housing. In order to be able to fulfil the aforementioned condition, this air coil must disadvantageously be constructed with a very large volume. Besides this, to effect a defined deflection considerable electrical power must be fed to the air coil, so that in connection with the deflection of the electron beam, a high amount of dissipated heat is undesirably released, which presents another disadvantage in view of the thermal problems which already occur in the operation of x-ray tubes.

In "Elektronenstrahl-Technologie," Wissentschaftliche Verlagsgesellschaft mbH, Stuttgart, 1977 pages 89 to 95, Siegfried Schiller et al. teaches to deflect an electron beam by means of an electromagnet formed as a yoke with two legs connected by a base part, whereby the electron beam passes through the region between pole shoes provided at the ends of the legs. This does enable a deflection of an electron beam with low loss; however, the undesirable defocusing phenomena still occur in the deflection of the electron beam.

SUMMARY OF THE INVENTION

It is an object of the present invention to provide an x-ray tube of the above type wherein the heat loss arising in the deflection of the electron beam is reduced, and the preconditions are created for a low structural space requirement of the deflecting arrangement without the occurrence of notable defocusing phenomena.

This object is inventively achieved in an x-ray tube with a cathode and an anode arranged in a vacuum housing, and an electromagnet for deflecting the electron beam traveling from the cathode to the anode which is formed as a preferably C-shaped yoke with two legs at whose ends pole shoes with mutually opposing pole faces are provided. The legs are connected with each other by a base section, with a winding surrounding the base section. The electron beam travels between the two pole shoes, each of which has a width, measured in a plane proceeding at a right angle to the main direction of propagation of the electron beam, which is not significantly less than the width of the pole faces, and the pole shoes are preferably constructed without a region of increasing width.

In the case of the inventive x-ray tube, the arrangement for magnetic deflection of the electron beam is thus formed by an electromagnet. Since the electron beam travels between the pole faces of the pole shoes of the yoke of the electromagnet, the largest magnetic flux of the magnetic field of the electromagnet is used to deflect the electron beam. The electrical power required to effect a defined deflection of the electron beam is thus small. As a result, only slight heat loss occurs in connection with the deflection of the electron beam. The possibility is low that defocusing phenomena will arise when the electron beam travels through the magnetic field, since, as a consequence of the utilization of an electromagnet with a yoke having pole shoes whose width is not considerably less than that of the pole faces, the magnetic field is nearly homogenous in the region between the pole faces, which, viewed in the direction toward the pole faces, preferably have no regions of increasing width. In addition, the geometric structure of the remaining region of the magnetic field traversed by the electron beam is shaped such that defocusing phenomena which the electron beam undergoes in passing through the part of the magnetic field located on the one side of the electromagnet are at least partially canceled out when the electron beam passes through the part of the magnetic field lying on the other side of the electromagnet. Additionally, it is advantageous that, due to the homogeneity of the magnetic field between the pole faces of the yoke, the deflection of the electron beam can be precisely influenced in a simple fashion by modification of the strength of the current flowing through the winding of the electromagnet.

The defocusing phenomena occurring in the path of the electron beam through the part of the magnetic field on one side of the electromagnet are then eliminated to a particularly significant extent in the path of the electron beam through the part of the magnetic field on the other side of the electromagnet if the main direction of propagation of the electron beam intersects the common center axis of the pole shoes substantially at a right angle.

A reduction of any residual defocusing phenomena which may possibly still occur can be achieved if the magnet is arranged such that the main direction of propagation of the electron beam intersects the common center axis of the pole shoes substantially at the midpoint of this axis. The electron beam then assumes a course with respect to the symmetry of the magnetic field (relative to a plane containing the center axes of the two pole shoes) which guarantees in a particularly extensive manner that the defocusing phenomena arising in the path of the electron beam through the part of the magnetic field located on the one side of the electromagnet are eliminated in the path of the electron beam through the part of the magnetic field located on the other side of the electromagnet. As used herein the "main direction of propagation of the electron beam" means the direction which this beam exhibits between the two pole shoes, or their pole faces, when the electron beam assumes a middle position residing between the two end (extreme) positions that can be reached by the deflection of the electron beam.

To guarantee the presence of a homogenous magnetic field of sufficient extent, in a variation of the invention the pole shoes of the electromagnet are shaped such that the magnetic field generated by the electromagnet is substantially homogenous in the dwell range of the electron beam in a plane proceeding substantially perpendicularly to the main direction of propagation of the electron beam and containing the common center axis of the pole shoes. In a further variation of the invention, the legs and the pole shoes have center axes which lie substantially in a single common plane, since the defocusing phenomena of the electron beam which arise on the opposite sides of the electromagnet then reciprocally cancel out to an even more improved extent.

It is another advantage of the invention that the pole shoes, or their pole faces, are located close to the electron beam being deflected, because the power which must be fed to the winding in order to effect a defined deflection is thereby low, and the electromagnet is small and cost effective. It is particularly favorable if, according to an embodiment of the invention, the cross-section of the shaft-like housing part (which separates the cathode chamber from the remainder of the vacuum housing) does not significantly exceed the size necessary for an unobstructed passage of the electron beam therethrough.

DESCRIPTION OF THE PREFERRED EMBODIMENTS

Figure 1:
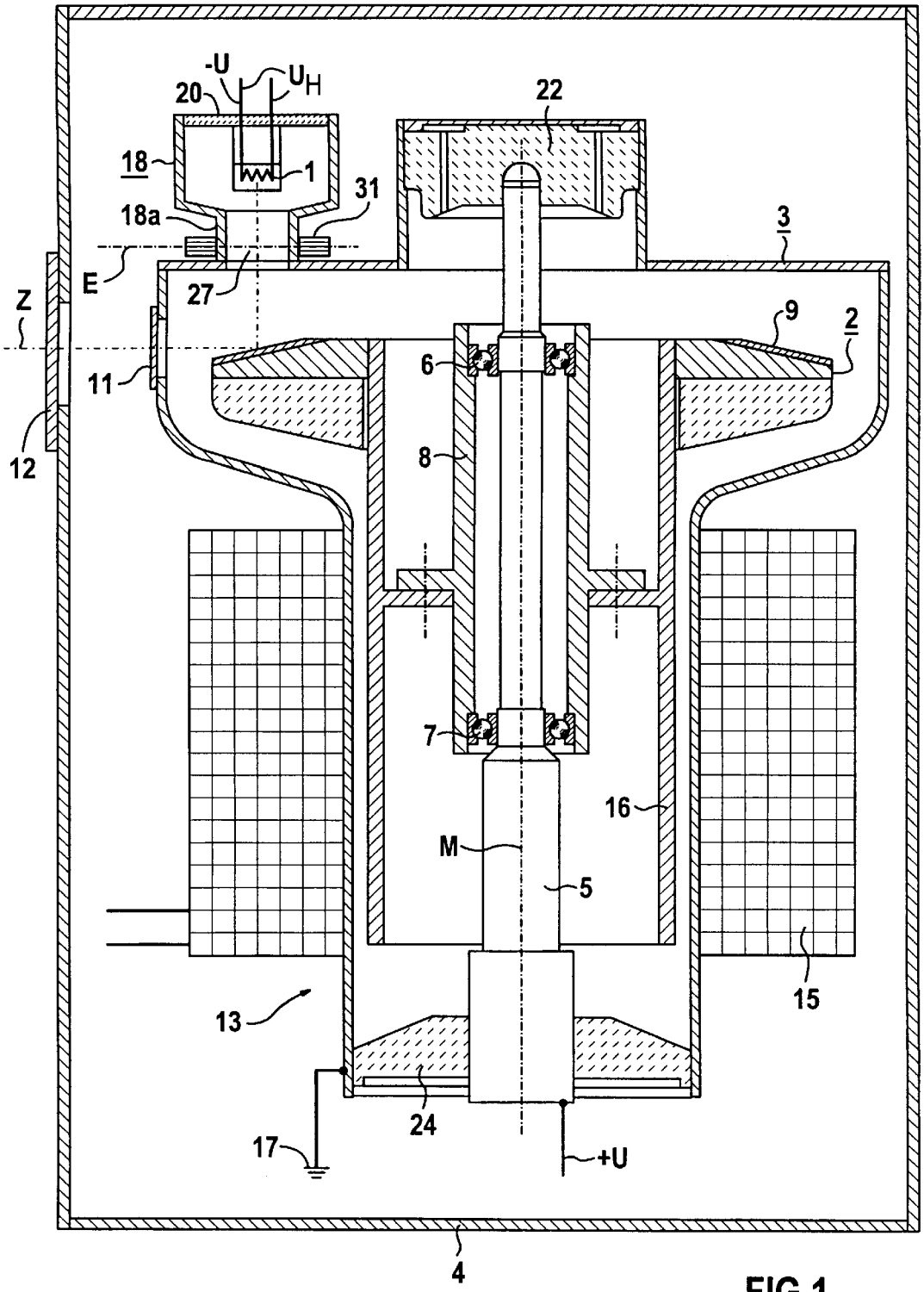
FIG. 1 shows an inventive x-ray tube in a schematic longitudinal section.

The x-ray tube according to FIG. 1 has a stationary cathode 1 and a rotating anode, generally designated 2, which are arranged in a vacuum-tight, evacuated vacuum housing 3 which is contained in a protective housing 4 filled with an electrically insulating liquid coolant, e.g. insulating oil. The rotating anode 2 is rotatably mounted on a stationary axle 5 in the vacuum housing 3 by means of two roller bearings 6, 7 and one bearing sleeve 8.

The rotating anode 2 is constructed rotationally symmetrical relative to the center axis M of the x-ray tube and has a surface 9 provided with a layer of tungsten-rhenium alloy, for example, on which an electron beam 10 emanating from the cathode 1 is incident for the generation of x-rays in the focal spot. (Only the center axis of the electron beam 10 is shown as a dashed line in FIGS. 1 and 3.) The corresponding active radiation bundle—of which only the center x-ray beam Z is shown in FIG. 1—exits through radiation exit windows 11 and 12 provided in the vacuum housing 3 and the protective housing 4, which are arranged in alignment.

To drive the rotating anode 2, an electromotor 13 is provided which is constructed as a squirrel-cage motor. The electromotor 13 has a stator 15 disposed at the exterior of the vacuum housing 3 and a rotor 16 located inside the vacuum housing 3 and co-rotatably connected to the rotating anode 2.

Aside from an insulator 20 carrying the cathode 1 and two insulators 22 and 24 accepting the axle 5, the vacuum housing 3 is formed of electrically conductive, non-magnetic materials and is at ground potential 17. A funnel-shaped housing section 18 is connected to the vacuum housing 3 via a shaft-like housing part 18*a*. The cathode 1 is mounted in the funnel-shaped housing section 18 by means of the insulator 20. The cathode 1 is thus located in a separate chamber of the vacuum housing 3, this chamber beings connected to the remainder of the vacuum housing 3 via the shaft-like housing part 18*a*.

The positive high voltage +U for the rotating anode 2 is supplied to the axle 5 which is accepted in the insulator 22 in a vacuum-tight fashion. The tube current thus flows via the roller bearings 6 and 7.

As is indicated in the schematic depiction in FIG. 1, one terminal of the cathode 1 is at the negative high voltage. The heating voltage UH is across the two terminals of the cathode 1. The lines leading to the cathode 1, the axle 5, the vacuum housing 3 and the stator 15 are connected in known fashion with a power supply (not depicted) located outside the protective housing 4, this power supply delivering the voltages required to operate the x-ray tube. It is clear from the preceding description that the exemplary embodiments of the x-ray tube according to FIG. 1 is of a type known as a bipolar type.

It is evident from FIG. 1 that the electron beam emanating form the cathode 1 travels through the shaft-like housing part 18*a* to the rotating anode 2. The shaft-like housing part 18*a* thus borders a diaphragm opening 27. The dimensions of the opening 27 are selected such that it does not substantially exceed the dimensions required for an unobstructed passage if the electron beam 10 therethrough.

At least the funnel-shaped housing part 18 and the upper wall (in FIG. 1) of the vacuum housing 3, and preferably all metallic parts of the vacuum housing 3, are constructed of non-magnetic materials, e.g. stainless steel and thus define volume at the exterior of the x-ray tube in which an electromagnet 31 is arranged (schematically indicated in FIG. 1) that serves to generate a magnetic deflecting field for the electron beam 10, which deflects this beam perpendicularly to the plane of the drawing in FIG. 1.

The electromagnet 31 is formed by a C-shaped yoke 33 with two legs 35, 36 that are connected to each other via a base section 34, with a winding 37 surrounding the base section 34. The legs 35, 36 are bent at a right angle in the region of their ends connected with the base section 34 in order to create space for the winding 37. At the free ends of the legs 35, 36, respective pole shoes 39, 40 are provided whose respective pole faces 41, 42 face each other, these surfaces running evenly and parallel to each other in the case of the exemplary embodiment described. The electromagnet 31 is arranged such that the shaft-like housing part 18*a* is located between the pole shoes 39, 40, or their pole faces 41, 42, which are located close to the shaft-like housing part 18*a*, or lie adjacent thereto as depicted in the FIGS.

The winding 37 of the electromagnet 31 has terminals connected with a current source (not depicted) which causes a current's to flow through the winding 37 in the operation of the x-ray tube. If the current flowing through the winding 37 is a direct current, the electron beam 10 propagating between the pole shoes 39, 40, or the pole faces 41, 42, is deflected in a static fashion such that the static position of the focal spot can be set. In the utilization of the x-ray tube in a computed tomography apparatus, for example, it is thus possible to set (adjust) the position of the focal spot relative to the center of rotation of the gantry of the computed tomography apparatus and to the radiation detector attached at the gantry opposite the x-ray tube.

If a periodic deflection of the electron beam 10 is desired, the current supplied to the winding 37 of the electromagnet 31 will have a saw-toothed, sinusoidal or triangular curve, for example.

The yoke 33 is constructed in known fashion from thin sheet lamellas. The legs 35, 36 and the pole shoes 39, 40 have center axes $M_1$, $M_2$, $M_3$ which lie substantially in a common plane E, with the two pole shoes 39, 40 have center axis $M_3$ in common. It is understood that to avoid impairing the magnetizing properties, the sheet lamellas of the yoke 33 must be annealed following their working (cutting and bending) in order to cancel the structural modifications caused by the working.

The two legs 35, 36, which are straight in the exemplary embodiment, each have a length L which is dimensioned such that the main direction of propagation R of the electron beam 10—see dashed line—intersects the common center axis $M_3$ of the pole shoes 39, 40 substantially at its midpoint.

Figure 2:
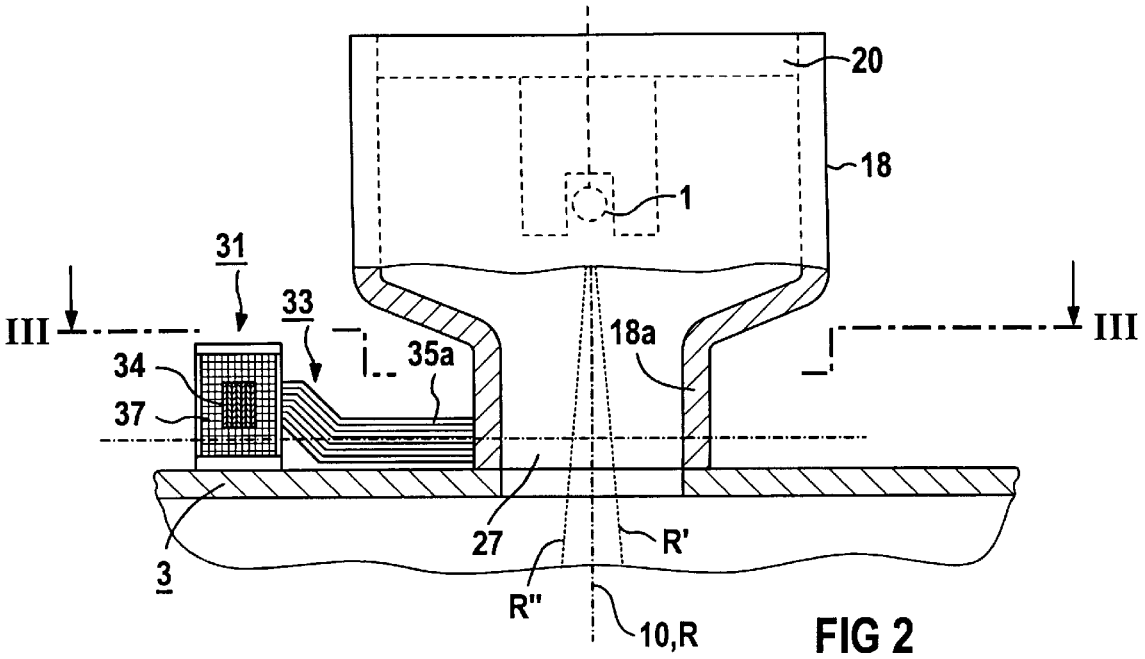
FIG. 2 shows a portion of the x-ray tube of FIG. 1 in a section taken along the line II—II in FIG 3.
Figure 3:
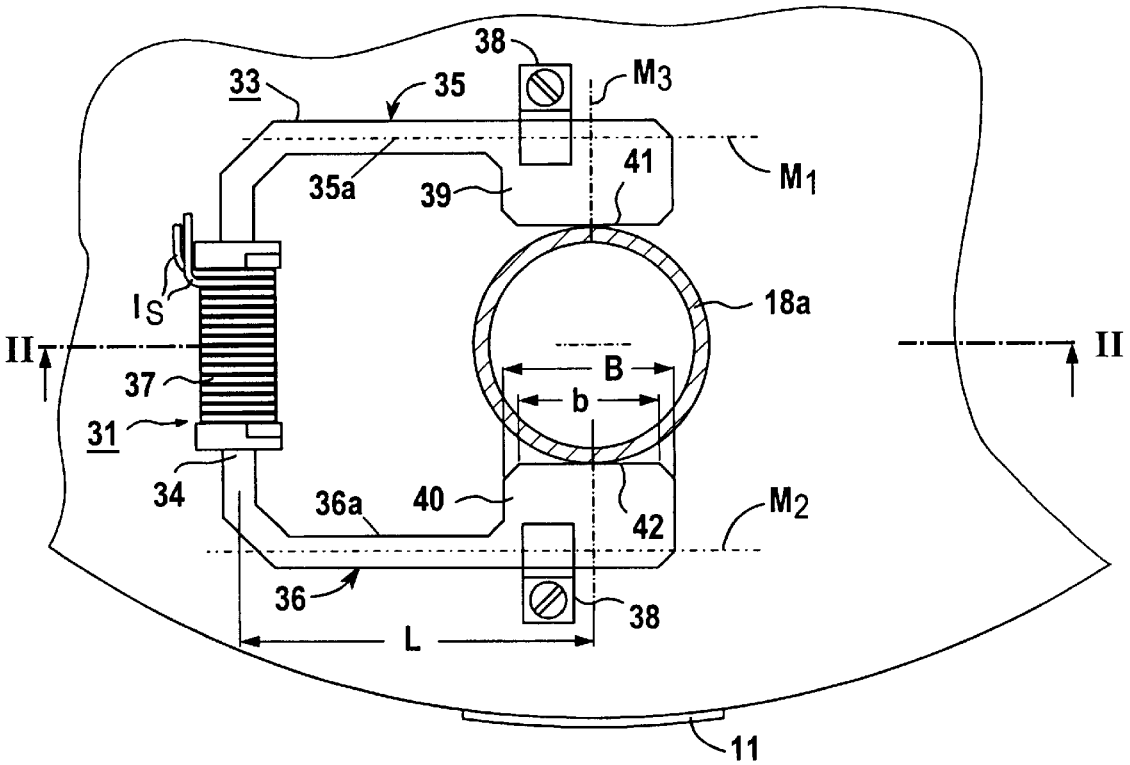
FIG. 3 shows a portion of the x-ray tube of FIG. 1 in a section taken along the line III—III in FIG. 2.

The electromagnet 31 is attached at the vacuum housing 3 such that the main direction of propagation R of the electron beam 10 proceeds at substantially a right angle to the center axes $M_1$, $M_2$, $M_3$ of the legs 35, 36 and to the plane E including the pole shoes 39, 40, as is evident from FIG. 1 in connection with FIGS. 2 and 3. FIG. 3 shows the paths of the electron beam 10 at the two end (extreme) positions that can be reached by the deflection of the electron beam 10. These paths are depicted with dotted lines and are designated R' and R", respectively.

As a result of the structure of the electromagnet 31 as described, its magnetic field is substantially homogenous in the plane E residing substantially perpendicularly to the main direction of propagation R of the electron beam 10 and is symmetrical to the plane E containing the sections 35*a*, 36*a* of the legs 35, 36. As a result of this, the described arrangement of the electromagnet 31 relative to the vacuum housing 3, the defocusing phenomena arising when the electron beam 10 passes through the part of the magnetic field located on one side of the plane E on its way through the shaft-like housing part 18*a* are virtually completely canceled when the electron beam 10 passes through the part of the magnetic field lying on the other side of the plane E.

The pole shoes 39, 40 each have a width B which is not less than the width b of the pole faces 41, 42; preferably, the width B of the pole shoes 39, 40 is greater than the width b of the pole faces 41, 42. Additionally, the pole shoes 39, 40 are shaped such that, proceeding from the respective legs 35, 36 that carry these pole shoes 39, 40, when viewed in the direction toward the respective pole face 41, or 42, these pole shoes do not have region of increasing width B, but rather decrease in their width B.

The width B of the pole shoes 39, 40 and the width b of the pole faces 41, 42 is measured in the plane of the drawing of FIG. 3 and thus at a right angle to the main direction of propagation of the electron beam, and at a right angle to the center axis $M_3$ of the pole shoes 39, 40.

The described arrangement of the electromagnet 31 also allows the pole shoes 39, 40, or their pole faces 41, 42, to reside very close to the electron beam 10, and thus only low power is required for deflection of the electron beam 10. Moreover, the dissipated heat from the electromagnet 31 produced during its operation can be conveyed without difficulty to the coolant located in the protective housing 4.

The electromagnet 31 is additionally very compact and can be fixed to the vacuum housing 3 very easily by means of two clamping parts 38 bolted to the vacuum housing 3, for example.

It is understood that the magnitude of the deflection of the electron beam 10 by means of the electromagnet 31 is taken into account in the dimensioning of the shaft-like housing part 18*a* as well as in the dimensioning of the diaphragm opening 27.

In the case of the exemplary embodiment described, the electromagnet 31 is located entirely outside the vacuum housing 3. It is possible, however, to arrange the electromagnet 31 entirely or partially inside the vacuum housing 3.

In the case of the exemplary embodiment described, besides the center axes of the legs 35, 36 and the pole shoes 39, 40 of the yoke 33 of the electromagnet 31, the center axis of the base section 34 also lies in the plane E; however, it is not necessary that the plane E contain the center axis of the base section 34.

Since the vacuum housing 3 is at ground 17 potential and thus at a more positive potential than the cathode 1, a large part of the electrons scattered by the rotating anode 2 are caught by the regions of the vacuum housing 3 bordering the diaphragm opening 27 and adjoining regions. Aside from its conventional function, the vacuum housing 3 thus fulfils the function of a diaphragm serving for reduction of the extrafocal radiation, particularly in the region of the housing part 18*a*.

With the possible exception of a small region in which the pole shoes 39, 40, or their pole faces 41, 42 lie adjacent to the exterior of the housing part 18*a*, the housing part 18*a* bordering or comprising the diaphragm opening 27 stands in contact directly with coolant located in the protective housing 4. Thus a good cooling is guaranteed so that thermal problems cannot arise.

As noted above, the x-ray tube depicted in FIG. 1 is of a type known as a bipolar x-ray tube. The inventive x-ray tube can also be constructed, however, as a unipolar x-ray tube. The vacuum housing 3 and the rotating anode 2 then are at the same potential, namely ground potential, while cathode 1 is at the negative high voltage −U. In order to cause that the rotating anode 2 and the vacuum housing 3 to both lie at ground potential 17, an end shield formed of an electrically conductive material can be provided instead of the insulator 22 and/or the insulator 24, so that an electrically conductive connection exists between the rotating anode 2 and the vacuum housing 3. The axle 5 can additionally or alternatively be connected to ground potential 17.

Although the invention is described above in the context of an x-ray tube with a rotating anode supported by roller bearings, it can also be used in x-ray tubes with a rotating anode supported by plain bearings, in rotating tubes (the vacuum housing rotates with the anode) and in x-ray tubes with a fixed anode.

Although various minor modifications might be suggested by those skilled in the art, it should be understood that our wish to embody within the scope of the patent warranted hereon all such modifications as reasonably and properly come with the scope of our contribution to the art.

We claim as our invention:

1. An x-ray tube comprising:

a vacuum housing;

a cathode and an anode contained in said vacuum housing, said cathode emitting an electron beam which proceeds along a main direction of propagation of the electron beam to strike said anode to generate x-rays;

an electromagnet disposed for interacting with said electron beam in said main direction of propagation of the electron beam;

said electromagnet comprising a yoke having two legs and a base section connecting said legs, with an electrical winding on said base section, each of said legs having a pole shoe with a pole face, the respective pole faces of the respective pole shoes of the respective legs being disposed facing each other with said main direction of propagation of the electron beam proceeding between said pole faces, said pole shoes having a common center axis proceeding perpendicularly to said main direction of propagation the electron beam; and each of said pole shoes having in a plane disposed at a right angle to said main direction of propagation of the electron beam a pole shoe width which is not less than a pole face width of the pole face thereof measured in a direction disposed at a right angle to said center axis.

2. An x-ray tube as claimed in claim 1 wherein each of said pole shoes, proceeding from the leg of said yoke on which the pole shoe is disposed, and as viewed in a direction from the pole face of the other leg, has no region of increasing pole shoe width.

3. An x-ray tube as claimed in claim 1 wherein said electromagnet is disposed so that said main direction of propagation of the electron beam intersects said common center axis substantially at a center of said common center axis.

4. An x-ray tube as claimed in claim 1 wherein each of said pole shoes has a shape for causing said electromagnet to generate a magnetic field which is substantially homogenous in a plane disposed substantially at a right angle to said main direction of propagation of the electron beam and containing said common center axis.

5. An x-ray tube as claimed in claim 1 wherein each of said legs has a longitudinal center axis, and wherein the respective longitudinal center axes of said legs and said common center axis are all substantially disposed in a common plane.

6. An x-ray tube as claimed in claim 1 wherein said vacuum housing comprises a cathode chamber in which said cathode is disposed and a remainder of the vacuum housing in which said anode is disposed, said cathode chamber being connected to said remainder of the vacuum housing by a hollow, cylindrical shaft-like part through which said main propagation direction of said electron beam proceeds, and wherein said pole shoes are respectively disposed on opposite sides of said housing part.

7. An x-ray tube as claimed in claim 6 wherein said housing part has a cross-section perpendicular to said main direction of propagation of said electron beam, which does not substantially exceed a size necessary for an unobstructed passage of said electron beam through said housing part.

8. An x-ray tube comprising:

a vacuum housing;

a cathode and an anode contained in said vacuum housing, said cathode emitting an electron beam which proceeds along a main direction of propagation of the electron beam to strike said anode to generate x-rays;

an electromagnet disposed for interacting with said electron beam in said main direction of propagation of the electron beam;

said electromagnet comprising a yoke having two legs and a base section connecting said legs, with an electrical winding on said base section, each of said legs having a pole shoe with a pole face, the respective pole faces of the respective pole shoes of the respective legs being disposed facing each other with said main direction of propagation of the electron beam proceeding between said pole faces, each of said pole shoes having a center axis; and each of said pole shoes having in a plane disposed at a right angle to said main direction of propagation of the electron beam a pole shoe width which is not less than a pole face width of the pole face thereof measured in a direction disposed at a right angle to the respective center axis.

9. An x-ray tube as claimed in claim 8 wherein said pole shoes have a common center axis proceeding perpendicularly to said main direction of propagation of the electron beam.

* * * * *